United States Patent [19]

Eigenbrode

[11] 4,092,058

[45] May 30, 1978

[54] CONNECTOR BLOCK

[75] Inventor: George Thomas Eigenbrode, Wilmington, Del.

[73] Assignee: E. I. Du Pont de Nemours and Company, Wilmington, Del.

[21] Appl. No.: 784,456

[22] Filed: Apr. 4, 1977

Related U.S. Application Data

[63] Continuation of Ser. No. 646,390, Jan. 2, 1976, abandoned.

[51] Int. Cl.[2] ..... H01R 9/16

[52] U.S. Cl. ..... 339/218 M; 29/629; 339/210 M; 339/220 R

[58] Field of Search ..... 339/59 R, 59 M, 220, 339/206 R, 206 P, 207 R, 209, 217 R, 63 R, 63 M, 218 R, 218 M, 210; 29/629

[56] References Cited

U.S. PATENT DOCUMENTS

| | | | |
|---|---|---|---|
| 3,512,121 | 5/1970 | Bergeron | 29/629 |
| 3,693,134 | 9/1972 | Trevisiol | 339/59 M |
| 3,899,236 | 8/1975 | Santos | 339/98 |
| 3,954,320 | 5/1976 | Hardesty | 339/99 R |

*Primary Examiner*—Roy Lake
*Assistant Examiner*—E. F. Desmond

[57] ABSTRACT

A connector block having a row of terminal-receiving cavities separated by side walls extending between the top wall and bottom wall of the block and an integral locking bar running the length of the block along the top wall above the cavities and projecting above the top wall. The bar is forced down through the top wall and into the side walls and is welded to the side walls so that it extends into the cavities and confines terminals in the cavities.

1 Claim, 5 Drawing Figures

CONNECTOR BLOCK

This is a continuation of my copending application Ser. No. 646,390 filed Jan. 2, 1976, now abandoned.

This invention relates to molded plastic connector blocks having terminal-receiving cavities therein. Conventionally, disconnect type terminals are positioned in the cavities to mate with leads extending into the cavities through lead-receiving openings. Various types of latches and locking pins have been proposed to retain the terminals in the cavities. See U.S. Pat. Nos. 3,441,661 3,697,933, 3,781,760 and Re 27,463.

According to the present invention, the connector block includes spaced top and bottom walls with a number of side walls extending between the top and bottom walls and defining a row of terminal-receiving cavities. The ends of the cavities on one side of the block are open to permit insertion of terminals in the cavities to positions where the ends of the terminals are located adjacent lead-receiving openings at the other ends of the cavities. An integral lock bar extends longitudinally along the top wall of the block and is integral with the cavity side walls. There are weakened joints between the bar and the top. Terminals are loaded into the cavities and are moved past the lock bar to their positions adjacent the lead-receiving openings. An ultra-sonically vibrating tool is then brought down against the lock bar to break the bar away from the top wall and force the bar against the side walls. The energy provided by the tool permits the bar to be forced into the side walls so that it extends into the cavities and prevents withdrawl of the terminals from the cavities. The bar is held in the collapsed position by welded joints with the side walls. Terminal tails conventionally extend outwardly of the cavities below the locking bar and are in electrical connection with circuit paths remote from the block.

The block is easily molded in one piece by use of a relatively simple mold. Following loading of the terminals into the cavities the lock bar is moved into the side walls and cavities in a simple one step operation with reduced labor over that required to insert conventional locking pins in blocks using such pins to hold the terminals in the cavities.

Other objects and features of the invention will become apparent as the description proceeds, especially when taken in conjunction with the accompanying drawings illustrating the invention, of which there is one sheet.

IN THE DRAWINGS

Figure 1:
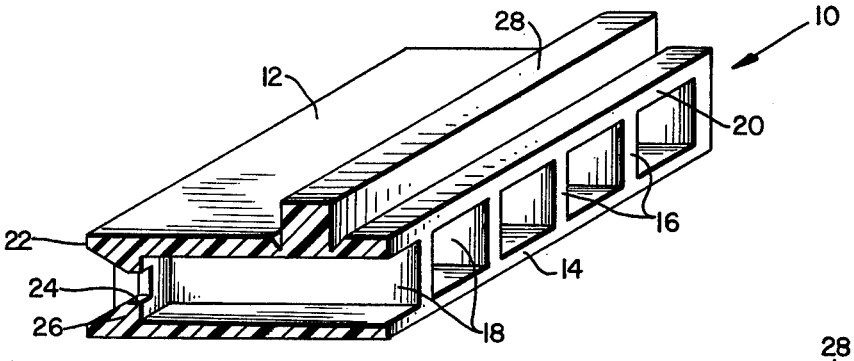
FIG. 1 is a perspective view of a sectioned connector block according to the invention.

Connector block 10 is preferably molded from a thermoplastic material, conventionally a glass filled nylon or polyester, although the particular type of plastic used forms no part of the invention. The block includes a top wall 12, bottom wall 14 and a number of spaced side walls 16 extending between the top and bottom walls and defining a number of terminal receiving cavities 18 extending from one side 20 of the block to the opposite side 22. Lead-receiving openings 24 are formed in cavity end wall 26 at side 22 to permit the insertion of leads into the cavities for electrical engagement with terminals confined within the cavities.

Figure 2:
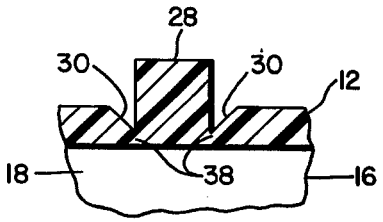
FIG. 2 is an enlarged fragmentary view of a portion of FIG. 1.
Figure 3:
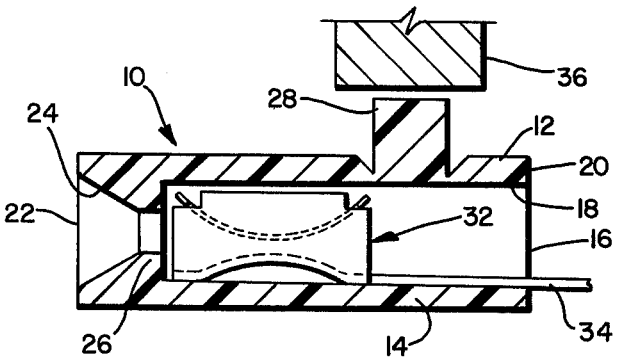
FIG. 3 is a sectional view illustrating a terminal inserted into a cavity in the block prior to collapse of the lock bar.

A plastic lock bar 28 integral with the block projects above and extends along the length of top wall 12 a distance spaced from the end wall 26 sufficient to permit terminals to be positioned between the lock bar and the end wall. The lock bar is formed during molding of the block 10 and is integrally joined to the tops of side walls 16. The thickness of the top wall 12 to either side of the lock bar 28 is reduced by notches 30, illustrated best in FIG. 2, so that when the lock bar is pushed down into the block by a tool, as will be described hereinafter in further detail, it breaks cleanly away from the top wall at the notches. Ideally, the notches 30 would extend entirely through the thickness of top wall 12 so that the lock bar would not be attached to the top wall. As a practical matter however, molding of the connector block is simplified by reducing the thickness of the top wall to either side of the lock bar without completely severing the bar from the top wall.

Terminals 32 are moved into the cavities 18 between the end wall 26 and lock bar 28 with terminal tails 34 extending along the bottom wall 14 and out of the cavities at side 20. In this position the terminals 32 mate with and form electrical connections with leads inserted into the cavities through openings 24. Terminal tails 34 are connected to suitable circuitry away from the block.

Figure 4:
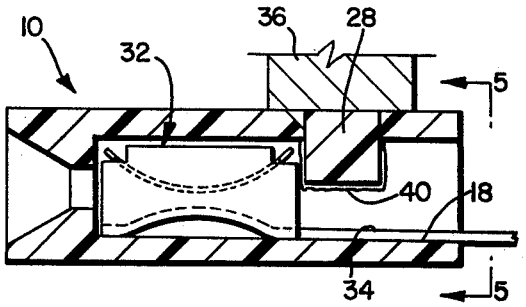
FIG. 4 is similar to FIG. 3 after collapse of the lock bar.
Figure 5:
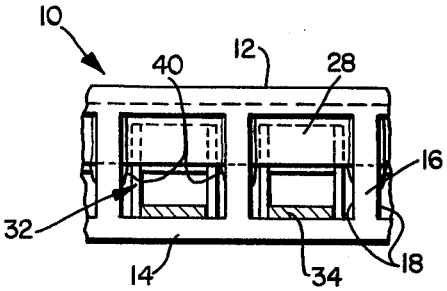
FIG. 5 is a view taken along line 5 — 5 of FIG. 4.

After positioning of terminals 32 in cavities 18, the block 10 is placed on a support and an ultra-sonically vibrated tool 36 extending the length of the lock bar 28 is brought into engagement with the lock bar 28 and is moved toward the support surface to move the lock bar from its initial elevated position above top wall 12 down through the top wall and into the interior of the block. Initial movement of the bar breaks the weakened joints 38 at notches 30 to free the bar from top wall 12. The ultra-sonically vibrated bar heats and displaces the plastic in the side walls, thus permitting the lowering of the bar to the position illustrated in FIG. 4 where tool 36 rests flush upon the top wall 12 and the bar extends into the cavities 18 behind terminals 32 to lock the terminals in the cavities. The ultra-sonic energy supplied by tool 36 is sufficient to melt the displaced plastic in side walls 18, thereby forming a welded pressure joint 40 between the bottom of the bar and each side wall. Weaker joints are formed between the sides of the bar and the sidewalls. The side joints are weaker because the tool does not press the sides of the bar against walls 16. The welded joints retain the bar in place to assure that terminals 32 are confined in the cavities.

In some certain situations, particularly where side walls 16 are relatively thin, the lock bar 28 may be collapsed into the block by a tool which is not ultrasonically vibrated. In this situation, the bar displaces the plastic material in the side walls without forming welded joints.

While I have illustrated and described a preferred embodiment of my invention, it is understood that this is capable of modification, and I therefore do not wish to be limited to the precise details set forth, but desire to avail myself of such changes and alterations as fall within the purview of the following claims. For instance, other types of elements, such as miniature light bulbs, thermistors and electrical or optical measuring units may be confined in a block as described.

What I claim as my invention is:

1. A connector block comprising a top wall, a bottom wall, spaced side walls extending between said top and bottom walls to define cavities, a terminal mounted in each cavity, and an elongated lock bar traversing and projecting through said top wall into said cavities adjacent said terminals, said bar being integral with said side walls in welded joints and having a side flush with the exterior of said top wall.

* * * * *